US009772153B1

(12) United States Patent
Findlay et al.

(10) Patent No.: US 9,772,153 B1
(45) Date of Patent: Sep. 26, 2017

(54) ROTARY AMMUNITION MAGAZINE AND FOLLOWER

(71) Applicant: Smith & Wesson Corp., Springfield, MA (US)

(72) Inventors: David S. Findlay, Athol, MA (US); Simon M. Muska, Enfield, CT (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/200,165

(22) Filed: Jul. 1, 2016

(51) Int. Cl.
*F41A 9/73* (2006.01)
*F41A 9/70* (2006.01)

(52) U.S. Cl.
CPC .. *F41A 9/73* (2013.01); *F41A 9/70* (2013.01)

(58) Field of Classification Search
CPC ..... F41A 9/70; F41A 9/74; F41A 9/77; F41A 9/73
USPC ..... 42/19, 16, 17, 15, 49.01, 6; 89/33.02, 89/139, 197, 132
See application file for complete search history.

(56) References Cited

U.S. PATENT DOCUMENTS 483,229 A * 9/1892 Lindner ..... F41A 9/73 42/19
608,023 A * 7/1898 Blake ..... F41A 9/73 124/48
696,118 A * 3/1902 Thorsen ..... F41A 19/45 42/16
1,696,537 A * 12/1928 Kewish ..... F41A 9/26 42/106
2,341,869 A 2/1944 Johnson, Jr.
3,239,959 A 3/1966 Sefried
3,562,944 A * 2/1971 Wagnet ..... F41A 17/38 42/50
3,745,687 A * 7/1973 Koon, Jr. ..... F41A 9/26 42/19
4,079,535 A 3/1978 Elbe et al.
4,314,419 A 2/1982 Koon, Jr.
4,332,097 A * 6/1982 Taylor, Jr. ..... F41A 9/73 42/50
4,453,329 A * 6/1984 Brint ..... F41A 9/02 42/15
4,487,103 A 12/1984 Atchisson
4,658,700 A 4/1987 Sullivan
4,689,907 A * 9/1987 Gwinn, Jr. ..... F41A 9/73 42/50

(Continued)

FOREIGN PATENT DOCUMENTS

AT 226114 B 2/1963
AT 254744 B 6/1967
GB 190600177 A 4/1906

*Primary Examiner* — John Cooper
(74) *Attorney, Agent, or Firm* — John A. Chionchio, Esquire; Ballard Spahr LLP

(57) ABSTRACT

A rotary ammunition magazine for a rifle has a follower that is spring biased and rotates about an axis to move cartridges for feeding to the rifle's chamber. The follower has a rib and/or a projection on a surface facing the cartridges. The rib engages the last cartridge in a stack and directs the force from the follower in the direction of movement of the cartridges within the magazine. The projection engages the extractor groove in the last cartridge to prevent it from moving under inertial forces caused by recoil. The rib engages and prevents the last cartridge from moving down the follower. The projection and rib prevent bolt override malfunctions.

27 Claims, 5 Drawing Sheets

(56) References Cited

U.S. PATENT DOCUMENTS

| | | | | |
|---|---|---|---|---|
| 5,014,456 | A * | 5/1991 | Kurtz | F41A 9/65 42/50 |
| 6,502,495 | B1 * | 1/2003 | Beary | F41A 17/36 89/33.17 |
| 7,698,844 | B2 | 4/2010 | Gruber et al. | |
| 8,069,601 | B1 * | 12/2011 | Fitzpatrick | F41A 9/62 42/50 |
| 8,156,675 | B2 * | 4/2012 | Heath | F41A 9/65 42/17 |
| 8,448,364 | B2 | 5/2013 | Davidson | |
| 8,484,875 | B2 | 7/2013 | Heath | |
| 8,745,912 | B2 | 6/2014 | Heath | |
| 9,228,788 | B1 * | 1/2016 | Simon | F41A 9/70 |
| 9,523,546 | B1 * | 12/2016 | Harding | F41A 9/71 |
| 2012/0117840 | A1 | 5/2012 | Chewning et al. | |
| 2014/0250752 | A1 | 9/2014 | Heath | |
| 2015/0121736 | A1 | 5/2015 | Faifer | |
| 2015/0241162 | A1 * | 8/2015 | Geraghty | F41A 9/65 42/6 |
| 2015/0292826 | A1 * | 10/2015 | Kielsmeier | F41A 9/70 42/50 |
| 2016/0290749 | A1 * | 10/2016 | McCormick | F41A 9/66 |

* cited by examiner

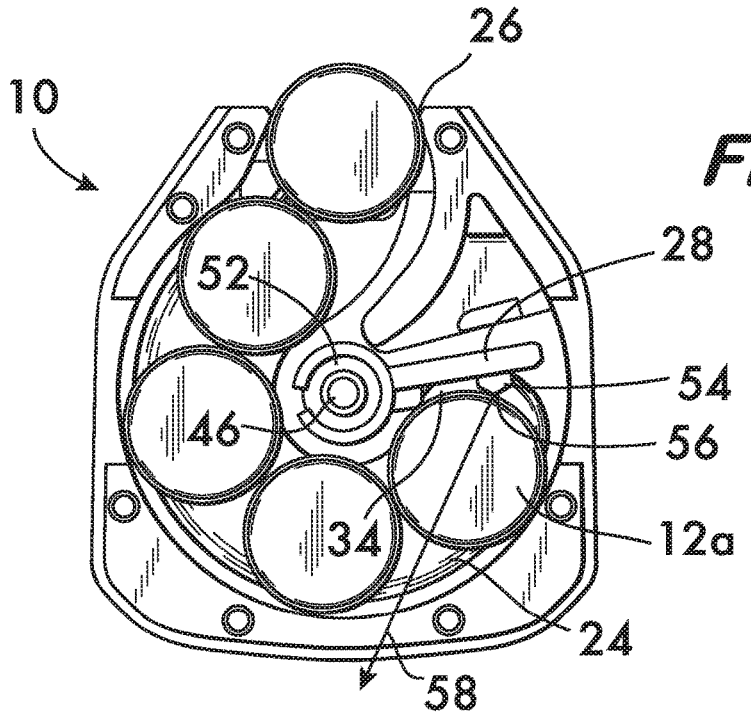
FIG. 6
FIG. 7
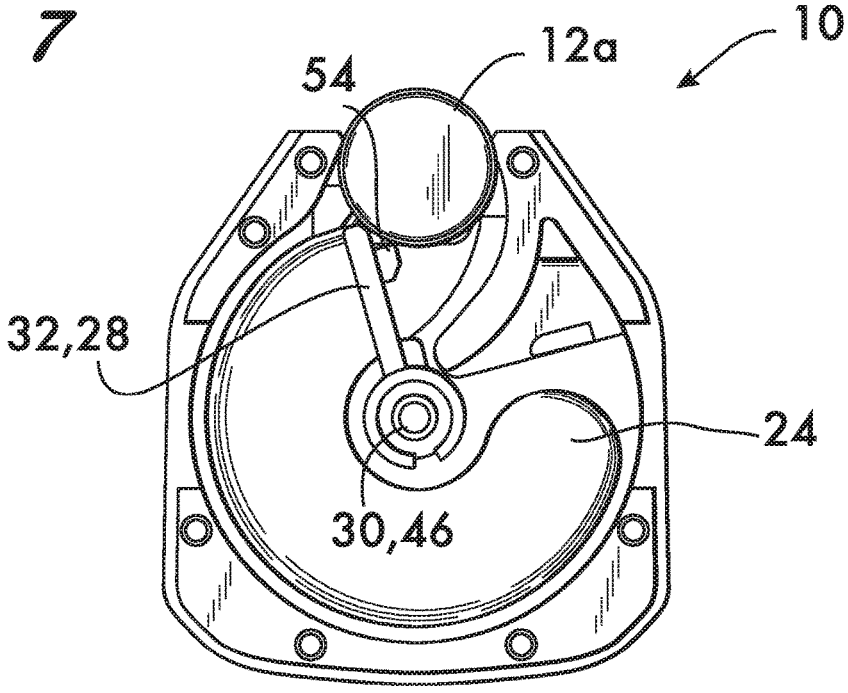

FIG. 8
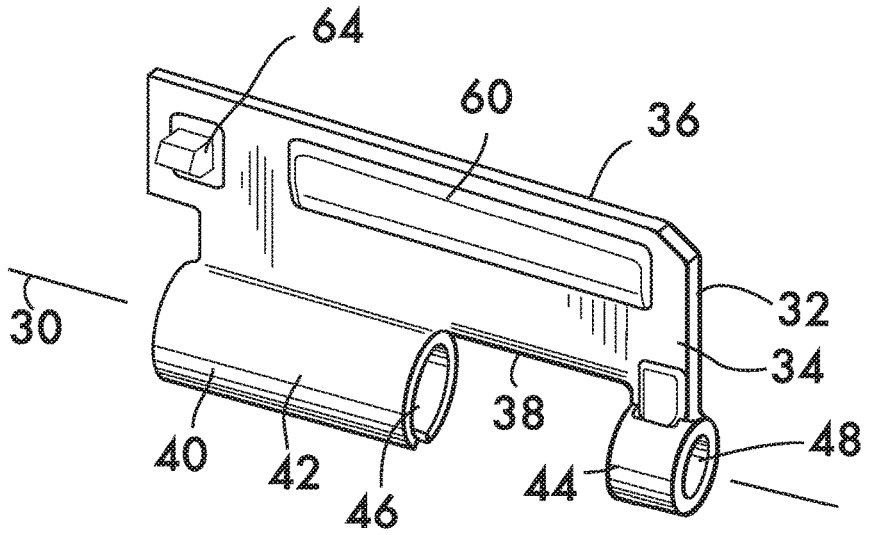
FIG. 9
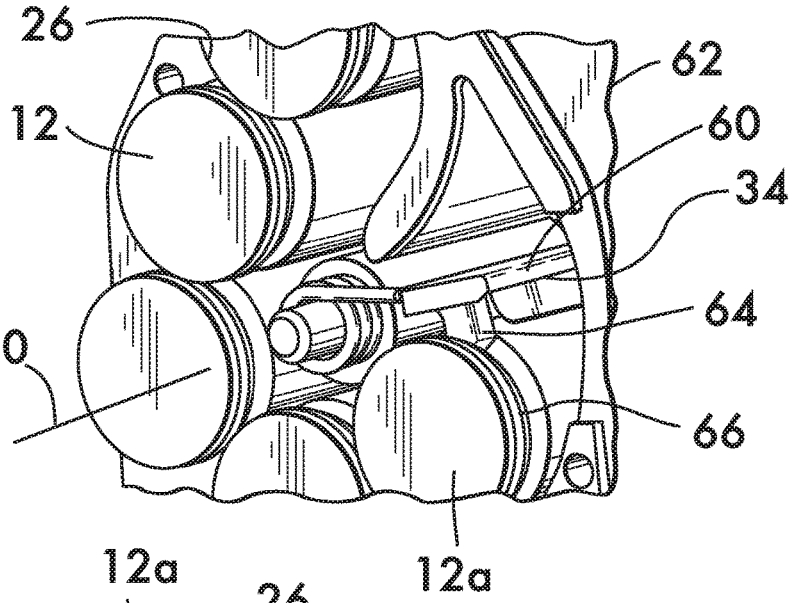
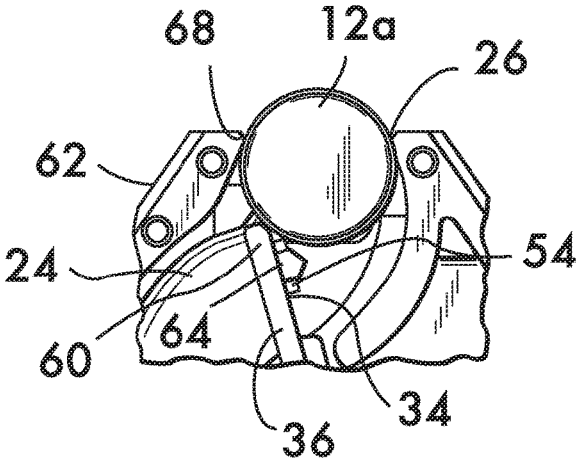
FIG. 10

ROTARY AMMUNITION MAGAZINE AND FOLLOWER

FIELD OF THE INVENTION

This invention relates to magazines for firearms.

BACKGROUND

It is desirable to decrease the malfunction rate of firearms, for example, bolt action rifles fed ammunition from rotary magazines. Some malfunctions are attributable to the characteristics of the magazine. An example prior art magazine 11 is shown in FIG. 1. Tests indicate that sources of firearm malfunction include the top cartridge 13*a* not being biased by the follower 15 sufficiently against the magazine lips 17, thereby allowing the cartridge to be forced back down into the magazine in response to inertial forces caused by recoil or by application of force by the rifle bolt during feeding. Some cartridges become trapped within the magazine as a result and are prevented from engaging the feed lips. Trapped cartridges are out of position for feeding upon cycling of the bolt and may cause a malfunction. Another malfunction is caused by top cartridge 13*a* slipping down the follower 15 away from the magazine lips 17. Even relatively small slippage may allow the bolt to override the top cartridge and not feed properly. Some malfunctions are believed rooted in the engagement between the follower and the last cartridge 13*b*, where it is observed that the force vector 19 between the follower 15 and the last cartridge 13*b* appears not to be in the most advantageous direction to urge the cartridges into engagement with the magazine lips 17. There is an opportunity to improve the reliability of firearms, particularly bolt action rifles, by improving the characteristics of the ammunition magazine.

SUMMARY

The invention concerns a follower for advancing cartridges in an ammunition magazine. In one example embodiment the follower comprises a plate having a surface positionable within the magazine facing one of the cartridges. The plate has at least one edge oriented parallel to an axis of rotation of the plate. A rib is mounted on the surface in spaced relation to the at least one edge. The rib is engageable with the one cartridge. A projection is mounted on the surface in spaced relation to the at least one edge. The projection is engageable with a groove of the one cartridge.

In one example the rib is oriented parallel to the at least one edge. By way of further example the rib comprises a flat surface engageable with the cartridge. In another example the rib comprises a corner surface engageable with the cartridge. In a particular example the corner surface comprises a radiused edge fillet. In another example the rib comprises a convexly curved surface engageable with the one cartridge.

In an example embodiment a bearing mounted on the at least one edge. In a specific example embodiment the bearing comprises at least one lug attached to the at least one edge. The at least one lug defines a bore coaxially aligned with the axis of rotation of the plate. In another example the bearing comprises first and second lugs attached to the at least one edge. The first and second lugs define respective first and second bores coaxially aligned with the axis of rotation of the plate.

Another example embodiment of a follower for advancing cartridges in an ammunition magazine comprises a plate having a surface positionable within the magazine facing one of the cartridges. The plate has at least one edge oriented parallel to an axis of rotation of the plate. A projection is mounted on the first surface in spaced relation to the at least one edge. The projection is engageable with a groove in the one cartridge. By way of example a rib is mounted on the surface in spaced relation to the at least one edge. The rib is engageable with the one cartridge. In one example the rib is oriented parallel to the at least one edge. By way of further example the rib comprises a flat surface engageable with the cartridge. In another example the rib comprises a corner surface engageable with the cartridge. In a particular example embodiment the corner surface comprises a radiused edge fillet. Further by way of example the rib comprises a convexly curved surface engageable with the one cartridge.

By way of example a bearing is mounted on the at least one edge. In a specific example embodiment the bearing comprises at least one lug attached to the at least one edge. The at least one lug defines a bore coaxially aligned with the axis of rotation of the plate. In another example the bearing comprises first and second lugs attached to the at least one edge. The first and second lugs define respective first and second bores coaxially aligned with the axis of rotation of the plate.

The invention also encompasses a magazine for holding a plurality of ammunition cartridges. In one example embodiment the magazine comprises a plurality of sidewalls defining a space for receiving the cartridges. An elongate opening is defined between a first and a second of the sidewalls providing access to the space. A follower is mounted within the space. The follower is rotatable about an axis of rotation oriented parallel to the elongate opening for urging the cartridges toward the opening. By way of example the follower comprises a plate having a surface positioned facing one of the cartridges. The plate has at least one edge oriented parallel to the axis of rotation. A rib is mounted on the surface in spaced relation to the at least one edge. The rib is engageable with the one cartridge. A spring biases the plate for rotation about the axis of rotation.

In one example embodiment the rib is oriented parallel to the at least one edge. In a specific example the rib comprises a flat surface engageable with the cartridge. In another example the rib comprises a corner surface engageable with the cartridge. In a particular example the corner surface comprises a radiused edge fillet. Further by way of example the rib comprises a convexly curved surface engageable with the one cartridge.

Another example embodiment further comprises a projection mounted on the first surface in spaced relation to the at least one edge. The projection is engageable with a groove of the one cartridge. A further example embodiment comprises a shaft mounted within the space. The shaft is coaxial with the axis of rotation. The plate is mounted on the shaft. By way of further example a bearing is mounted on the at least one edge. The bearing engages the shaft. In an example embodiment the bearing comprises at least one lug mounted on the at least one edge. The at least one lug defines a bore receiving the shaft. In one example embodiment the bearing comprises first and second lugs attached to the at least one edge. The first and second lugs define respective first and second bores receiving the shaft.

In a particular example embodiment, one end of the shaft is supported on a third one of the sidewalls and an opposite end of the shaft is supported on a fourth one of the sidewalls. The third and fourth sidewalls are at opposite ends of the magazine. Further by way of example the spring comprises a coil spring acting between the plate and one of the sidewalls.

Another example embodiment of a magazine for holding a plurality of ammunition cartridges comprises a plurality of sidewalls defining a space for receiving the cartridges. An elongate opening is defined between a first and a second of the sidewalls providing access to the space. A follower is mounted within the space. The follower is rotatable about an axis of rotation oriented parallel to the elongate opening for urging the cartridges toward the opening. The follower comprises a plate having a surface positioned facing one of the cartridges. The plate has at least one edge oriented parallel to the axis of rotation. A projection is mounted on the surface in spaced relation to the at least one edge. The projection is engageable with a groove in the one cartridge. A spring biases the plate for rotation about the axis of rotation.

An example embodiment further comprises a rib mounted on the first surface in spaced relation to the at least one edge. The rib is engageable with the one cartridge. By way of example the rib is oriented parallel to the at least one edge. In one example embodiment the rib comprises a flat surface engageable with the cartridge. In another example embodiment the rib comprises a corner surface engageable with the cartridge. In a specific example the corner surface comprises a radiused edge fillet. By way of further example the rib comprises a convexly curved surface engageable with the one cartridge.

A further example embodiment comprises a shaft mounted within the space. The shaft is coaxial with the axis of rotation. The plate is mounted on the shaft. A further example comprises a bearing mounted on the at least one edge. The bearing engages the shaft. In one example embodiment the bearing comprises at least one lug mounted on the at least one edge. The at least one lug defines a bore receiving the shaft. In another example embodiment the bearing comprises first and second lugs attached to the at least one edge. The first and second lugs define respective first and second bores receiving the shaft.

In an example embodiment one end of the shaft is supported on a third one of the sidewalls and an opposite end of the shaft is supported on a fourth one of the sidewalls. The third and fourth sidewalls are at opposite ends of the magazine. In a particular example embodiment the spring comprises a coil spring acting between the plate and one of the sidewalls.

BRIEF DESCRIPTION OF THE DRAWINGS

FIGS. 6 and 7 are cross sectional views taken at line 6-6 of FIG. 2;

FIG. 8 is an isometric view of another example embodiment of a follower for an example rotary ammunition magazine according to the invention;

FIG. 9 is a partial sectional isometric view showing the example follower of FIG. 8 used in an example ammunition magazine according to the invention; and FIG. 10 is a partial sectional view showing the example follower of FIG. 8 used in an example ammunition magazine according to the invention.

DETAILED DESCRIPTION

Figure 1:
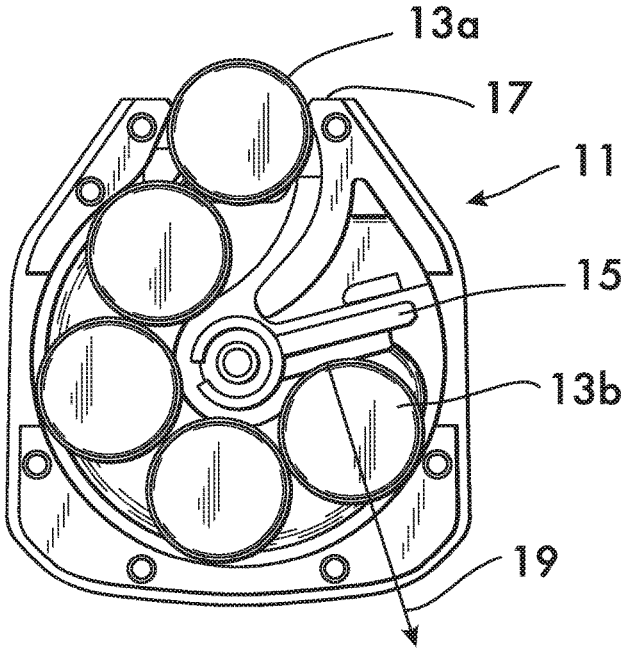
FIG. 1 PRIOR ART
FIG. 1 is a cross sectional view through an example prior art rotary ammunition magazine.
Figure 2:
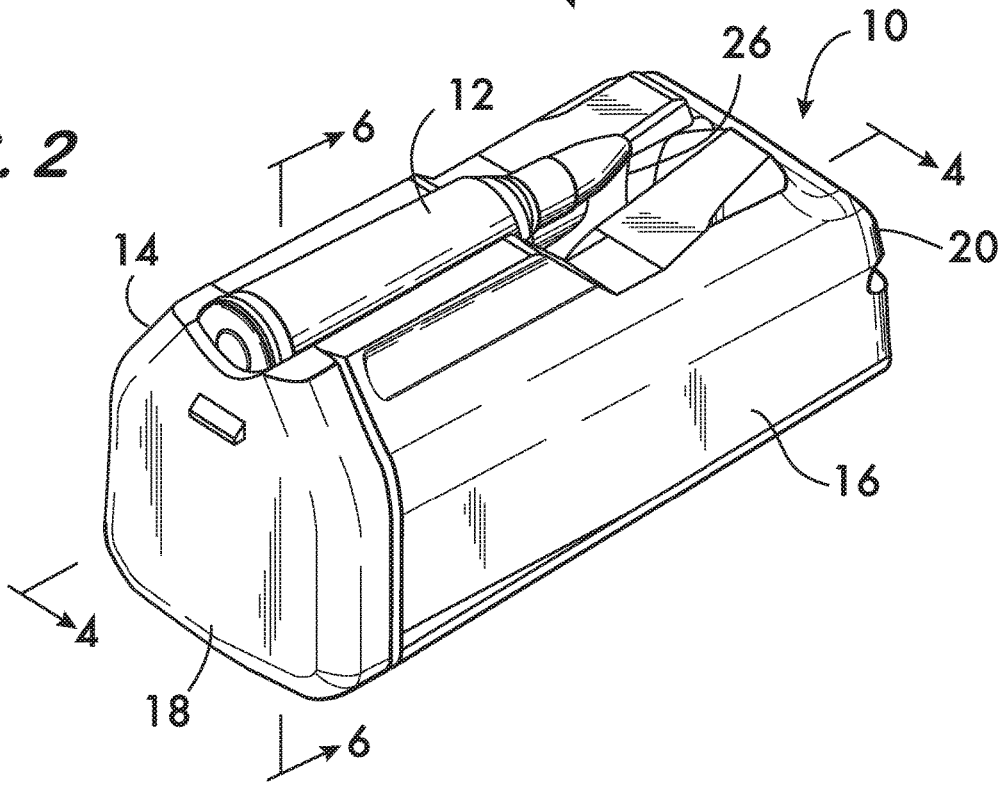
FIG. 2 is an isometric view of an example rotary ammunition magazine according to the invention.
Figure 3:
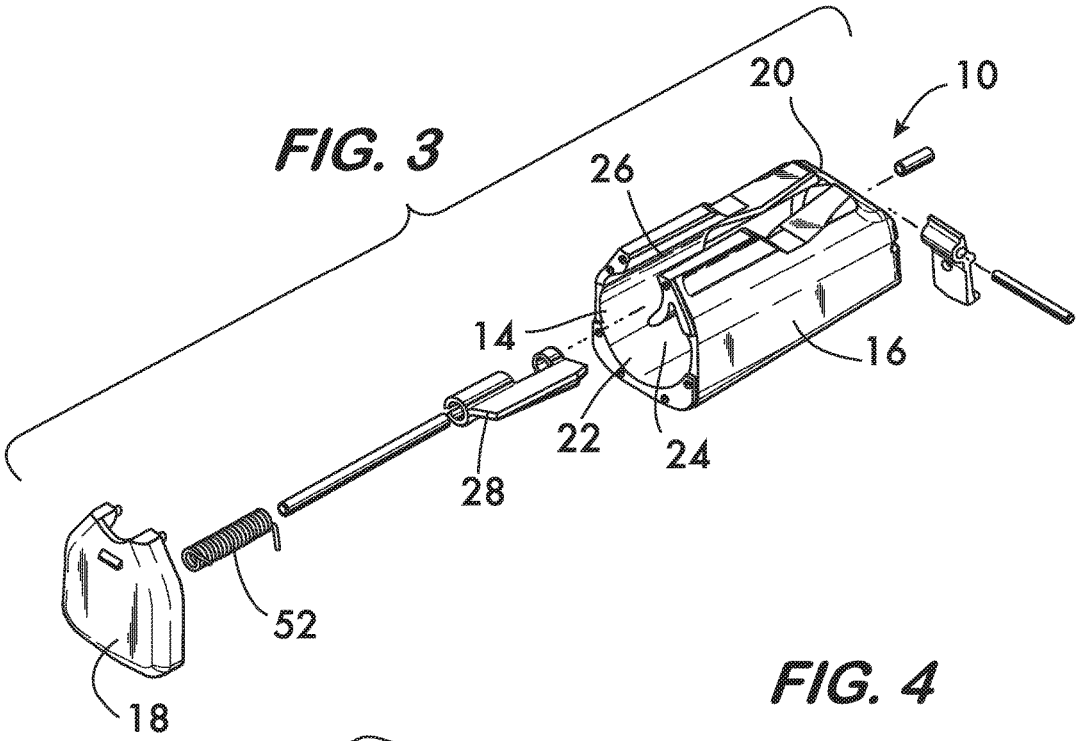
FIG. 3 is an exploded isometric view of the example rotary ammunition magazine shown in FIG. 2.
Figure 4:
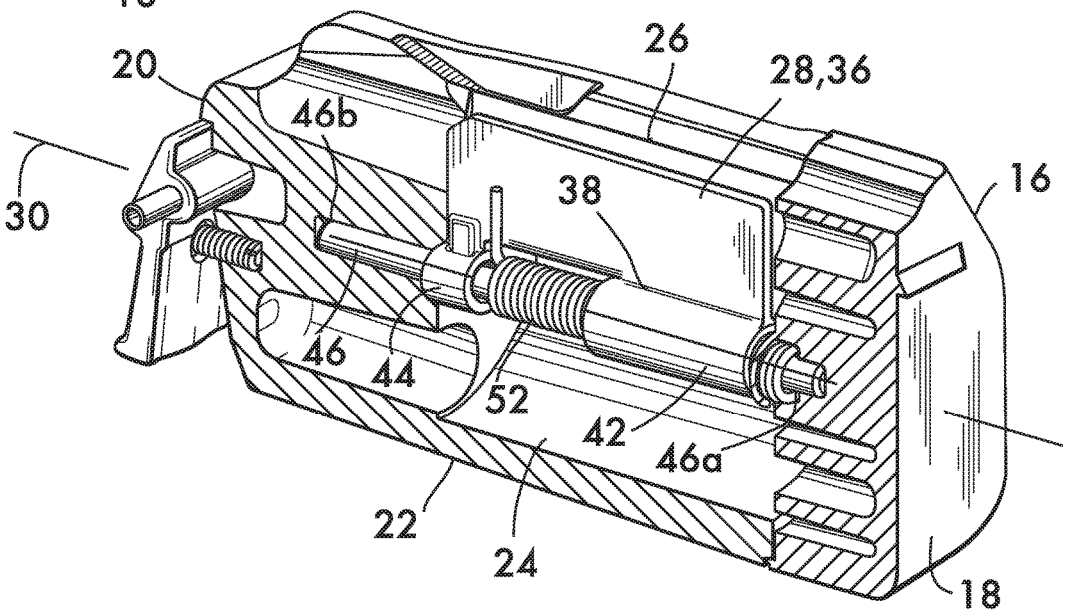
FIG. 4 is a longitudinal isometric sectional view taken at line 4-4 of FIG. 2.

FIGS. 2 and 3 show an example magazine 10 according to the invention for holding a plurality of ammunition cartridges 12. Magazine 10 comprises a plurality of sidewalls 14, 16, 18, 20 and 22 defining a space 24 for receiving the cartridges 12. An elongate opening 26 is defined between a first sidewall 14 and a second sidewall 16, the opening providing access to space 24 permitting loading and removal of the cartridges 12 to and from the magazine 10. As shown in FIGS. 3 and 4, a follower 28 is mounted within the space 24. Follower 28 is rotatable about an axis of rotation 30 oriented parallel to the elongate opening 26. In the example shown in FIG. 5, the follower 28 comprises a plate 32 having first and second side surfaces 34 and 36 oppositely disposed. Plate 32 further has an edge 38 oriented parallel to the axis of rotation 30 (see FIG. 4).

Mounting of the follower 28 within space 24 is effected via one or more bearings 40 mounted on edge 38. In this example embodiment the bearings 40 comprise first and second lugs 42 and 44. Each lug 42, 44 defines a respective bore 42*a*, 44*a* which receives a shaft 46, as shown in FIG. 4. Shaft 46 is coaxial with the axis of rotation 30. One end, 46*a* of shaft 46, is supported on the third sidewall 18, and the opposite end, 46*b* of shaft 46, is supported on the fourth sidewall 20. The third and fourth sidewalls comprise opposite ends of the magazine 10. As shown in FIGS. 3 and 4, a coil spring 52 acts between the plate 32 and the sidewall 20 to bias the plate in rotation about the axis of rotation 30 to urge the cartridges toward the opening 26.

Figure 5:
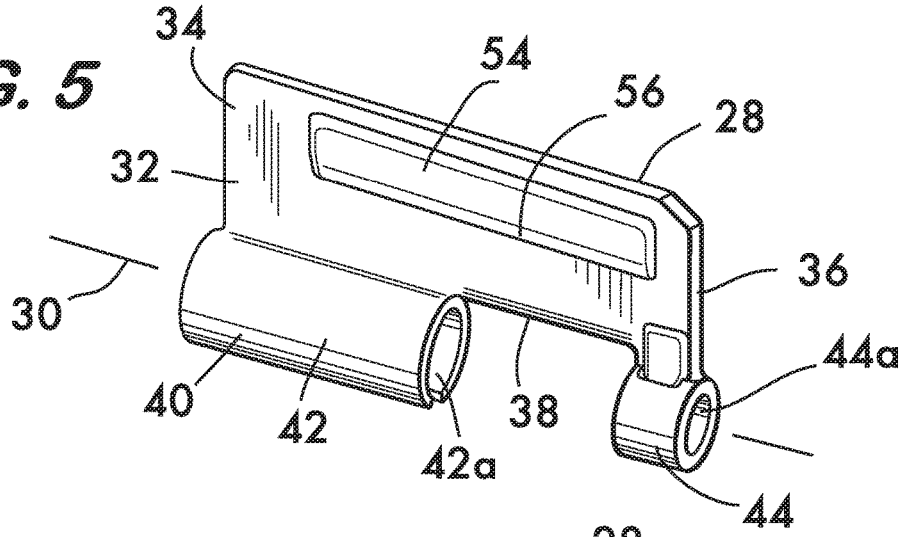
FIGS. 5, 5A and 5B are isometric views of example followers for the example rotary ammunition magazine shown in FIG. 2.
Figure 5A:
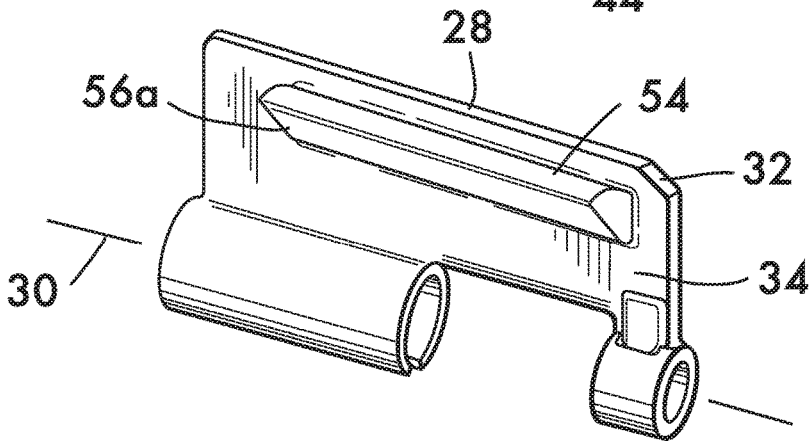
Figure 5B:
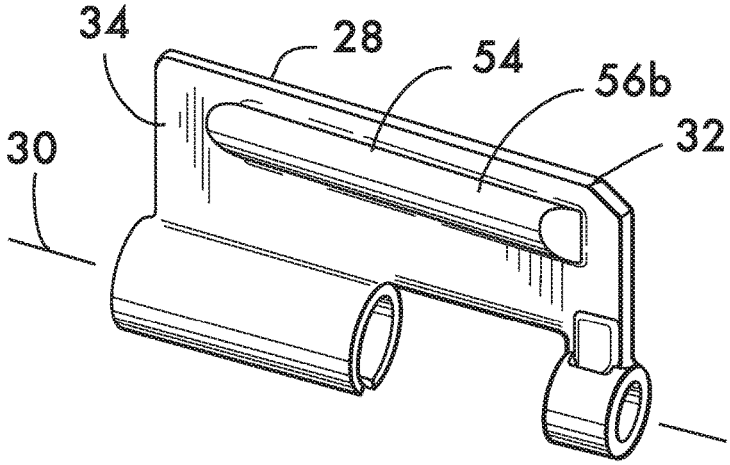

As shown in FIG. 5, a rib 54 is mounted on the first side surface 34 of plate 32. In this example the rib 54 is oriented parallel to and in spaced relation from the edge 38. As shown in FIG. 6, side surface 34 faces the cartridges 12 thus permitting the rib 54 to engage the lowermost cartridge 12*a* in the stack of cartridges within the space 24. By way of further example the rib 54 has a corner surface 56 engageable with the cartridge 12*a*. In a practical embodiment, corner surface 56 comprises a radiused edge fillet. FIG. 5A shows an example rib 54 having a flat surface 56*a* engageable with the cartridge 12*a*. FIG. 5B shows another example rib 54 comprising a convexly curved surface 56*b* engageable with the cartridge 12*a*. Regardless of which embodiment is employed, rib 54 is positioned, shaped and sized so that the force vector 58 which it applies to the cartridge 12 is pointed more in the direction of motion of the cartridge 12*a* within the space 24 than in the prior art magazine. Thus, the torque applied by the spring 52 to the plate 32 is better harnessed to push the cartridges toward the elongate opening 26 because the angle between the applied force and the direction of motion is smaller, resulting in a greater force applied to the cartridge 12*a*. Furthermore, as shown in FIG. 7, the rib 54 supports the last cartridge 12*a* in the magazine 10 and helps it resist falling back into the space 24, thereby lessening the chance of bolt override of the last cartridge. The follower 28 comprising the plate 32 and the rib 54 according to the invention is expected to improve ammunition feed by reducing malfunctions.

FIGS. 8-10 show another example embodiment of a follower 60 usable in an example magazine 62 according to the invention. As shown in FIG. 8, follower 60 is similar to follower 28 in that it comprises a plate 32 having oppositely disposed side surfaces 34 and 36 and at least one edge 38. A bearing 40 is mounted on the edge 38 and defines an axis of rotation 30. Bearing 40 comprises one or two lugs 42 and 44 which have respective bores 46 and 48 which are coaxially aligned with the axis of rotation 30.

When follower 60 is positioned within the magazine 62 as shown in FIGS. 9 and 10 the plate side surface 34 faces cartridge 12*a*, and a projection 64 is mounted on the side surface 34. Projection 64 is positioned in spaced relation to edge 38 (see also FIG. 8) to engage an extractor groove 66 of the last cartridge 12*a* (see FIG. 9) as the follower 60 pushes the stack of cartridges 12 toward the opening 26 of magazine 62. Engagement between the projection 64 and the extractor groove 66 prevents the last cartridge 12*a* from moving in the opposite direction to the forces of recoil when the firearm is discharged. However, as shown in FIG. 10, the projection 64 is dimensioned and positioned so as to disengage from the groove 66 when the last cartridge 12 is positioned at the opening 26 of the magazine 62, ready to be stripped from the magazine and chambered by a bolt (not shown). Disengagement occurs, for example, when the bolt is opened and the follower 60 advances the last round 12*a* against the retaining lips 68 of the magazine 62. Engagement between the projection 64 and the extractor groove 66 is expected to mitigate feeding malfunctions by maintaining the last round in the proper position for feeding against inertial forces due to recoil. Although FIG. 8 shows an example follower 60 having both the projection 64 and the rib 54, it is understood that a follower according to the invention may have a rib only, a projection only, or both a rib and a projection.

Ammunition magazines using followers according to the invention are expected to reduce feeding malfunctions, especially in bolt action rifles.

What is claimed is:

1. A follower for advancing cartridges in an ammunition magazine, said follower comprising:

a plate having a surface positionable within said magazine facing one of said cartridges, said plate having at least one edge positioned in spaced relation to an axis of rotation of said plate;

a projection mounted on said surface in spaced relation to said at least one edge, said projection being position to engage a groove in said one cartridge until said at least one edge engages said one cartridge, said projection then being disengaged from said groove, said cartridge being supported on said at least one edge.

2. The follower according to claim 1, further comprising:

a rib mounted on said surface, said rib being engageable with said one cartridge.

3. The follower according to claim 2, wherein said rib is oriented parallel to said axis of rotation.

4. The follower according to claim 2, wherein said rib comprises a flat surface engageable with said one cartridge.

5. The follower according to claim 2, wherein said rib comprises a corner surface engageable with said one cartridge.

6. The follower according to claim 5, wherein said corner surface comprises a radiused edge fillet.

7. The follower according to claim 2, wherein said rib comprises a convexly curved surface engageable with said one cartridge.

8. The follower according to claim 2, wherein said rib is mounted on said surface in spaced relation to said axis of rotation.

9. The follower according to claim 1, further comprising a bearing mounted on said plate.

10. The follower according to claim 9, wherein said bearing comprises at least one lug, said at least one lug defining a bore coaxially aligned with said axis of rotation.

11. The follower according to claim 9, wherein said bearing comprises first and second lugs, said first and second lugs defining respective first and second bores coaxially aligned with said axis of rotation.

12. The follower according to claim 1, wherein said projection is mounted on said surface in spaced relation to said axis of rotation.

13. A magazine for holding a plurality of ammunition cartridges, said magazine comprising:

a plurality of sidewalls defining a space for receiving said cartridges;

an elongate opening defined between a first and a second of said sidewalls providing access to said space;

a follower mounted within said space, said follower being rotatable about an axis of rotation oriented parallel to said elongate opening for urging said cartridges toward said opening, said follower comprising:

a plate having a surface positioned facing one of said cartridges, said plate having at least one edge positioned in spaced relation to said axis of rotation;

a projection mounted on said surface in spaced relation to said at least one edge, said projection being positioned to engage a groove in said one cartridge until said at least one edge engages said cartridge, said projection then being disengaged from said groove, said cartridge being supported on said at least one edge;

a spring biasing said plate for rotation about said axis of rotation.

14. The magazine according to claim 13, further comprising a rib mounted on said surface, said rib being engageable with said one cartridge.

15. The magazine according to claim 14, wherein said rib is oriented parallel to said axis of rotation.

16. The follower according to claim 14, wherein said rib comprises a flat surface engageable with said one cartridge.

17. The follower according to claim 14, wherein said rib comprises a corner surface engageable with said one cartridge.

18. The follower according to claim 17, wherein said corner surface comprises a radiused edge fillet.

19. The magazine according to claim 14, wherein said rib comprises a convexly curved surface engageable with said one cartridge.

20. The follower according to claim 14, wherein said rib is mounted on said surface in spaced relation to said axis of rotation.

21. The magazine according to claim 13, further comprising a shaft mounted within said space, said shaft being coaxial with said axis of rotation, said plate being mounted on said shaft.

22. The magazine according to claim 21, further comprising a bearing mounted on said plate, said bearing engaging said shaft.

23. The magazine according to claim 22, wherein said bearing comprises at least one lug, said at least one lug defining a bore receiving said shaft.

24. The magazine according to claim 22, wherein said bearing comprises first and second lugs, said first and second lugs defining respective first and second bores receiving said shaft.

25. The magazine according to claim 21, wherein one end of said shaft is supported on a third one of said sidewalls and an opposite end of said shaft is supported on a fourth one of said sidewalls, said third and fourth sidewalls being at opposite ends of said magazine.

26. The magazine according to claim 13, wherein said spring comprises a coil spring acting between said plate and one of said sidewalls.

27. The follower according to claim 13, wherein said projection is mounted on said surface in spaced relation to said axis of rotation.

* * * * *